US007722377B2

(12) United States Patent
Moore

(10) Patent No.: US 7,722,377 B2
(45) Date of Patent: May 25, 2010

(54) POWER CONNECTION SYSTEM

(76) Inventor: Harold G. Moore, 224 Berry La., Staunton, VA (US) 24401

( * ) Notice: Subject to any disclaimer, the term of this patent is extended or adjusted under 35 U.S.C. 154(b) by 0 days.

(21) Appl. No.: 12/453,005

(22) Filed: Apr. 27, 2009

(65) Prior Publication Data

US 2009/0286415 A1 Nov. 19, 2009

Related U.S. Application Data

(60) Provisional application No. 61/071,787, filed on May 16, 2008.

(51) Int. Cl.
*H01R 13/625* (2006.01)

(52) U.S. Cl. ..... 439/341; 439/347; 439/530

(58) Field of Classification Search ..... 439/341, 439/347, 530, 345, 502
See application file for complete search history.

(56) References Cited

U.S. PATENT DOCUMENTS

| | | | | | |
|---|---|---|---|---|---|
| 1,607,712 | A | * | 11/1926 | White | 439/530 |
| 2,434,026 | A | | 1/1948 | Walters | |
| 4,515,423 | A | * | 5/1985 | Moore et al. | 439/502 |
| 4,869,681 | A | * | 9/1989 | Vache et al. | 439/341 |
| 5,104,331 | A | * | 4/1992 | Goble | 439/341 |
| 5,302,136 | A | * | 4/1994 | St. Germain et al. | 439/376 |
| 5,425,645 | A | | 6/1995 | Skovdal et al. | |
| 5,639,253 | A | * | 6/1997 | Rantanen | 439/341 |
| 5,667,393 | A | | 9/1997 | Grabbe et al. | |
| 5,692,918 | A | * | 12/1997 | Hill | 439/323 |
| 5,716,219 | A | | 2/1998 | Noike | |
| 6,036,549 | A | | 3/2000 | Wulff | |
| 6,302,717 | B1 | | 10/2001 | Cheung | |
| 6,319,039 | B1 | * | 11/2001 | Chambly | 439/347 |
| 6,439,911 | B1 | | 8/2002 | Conorich | |
| 6,609,924 | B2 | | 8/2003 | Zeiler et al. | |
| 6,910,911 | B2 | * | 6/2005 | Mellott et al. | 439/358 |
| 7,306,471 | B2 | | 12/2007 | Shau-din | |
| 2004/0077222 | A1 | | 4/2004 | AbuGhazaleh et al. | |
| 2004/0166730 | A1 | * | 8/2004 | Wascow et al. | 439/577 |
| 2005/0085117 | A1 | * | 4/2005 | Bartholoma et al. | 439/347 |

* cited by examiner

*Primary Examiner*—Gary F. Paumen
(74) *Attorney, Agent, or Firm*—Richard C. Litman

(57) ABSTRACT

The power connection system for a power tool includes a housing defining a recess, a plurality of electrical connector guide grooves, an electric motor connected to a tool member, an electric circuit connected to the motor, and arcuate electrical contact prongs disposed in the recess. The power cord has complementary arcuate receptacles removably engageable with the prongs, the cord being connectable to a power source to connect the power tool to the power source, and a lock pin that locks the power cord to the housing. The power cord may be universally connected to any power tool having a similar recess with arcuate prongs.

14 Claims, 5 Drawing Sheets

POWER CONNECTION SYSTEM

CROSS-REFERENCE TO RELATED APPLICATION

This application claims the benefit of U.S. Provisional Patent Application Ser. No. 61/071,787, filed May 16, 2008.

BACKGROUND OF THE INVENTION

1. Field of the Invention

The present invention relates to power tools and, more particularly, to a power connection system having a power cord that is interchangeable among a variety of power tools.

2. Description of the Related Art

A power tool generally includes a housing with an electric motor disposed therein, the electric motor driving a tool element, such as, e.g., a reciprocating sanding member. The motor is electrically connected to an electrical power source by a power cord. Typically, the power cord is directly wired to the electrical circuit of the motor, such as to the on/off switch, and is non-irremovably fixed to the housing or handle of the power tool.

One problem with the above-described power tool is that, if the power cord is damaged or accidentally severed during operations, a cord must be rewired to the electrical circuit. In order to rewire the new cord, the handle of the power tool must be disassembled so that the new cord can be directly wired to the on/off switch. Alternatively, if a sufficient length of the damaged cord is still connected to the power tool, a new plug can be rewired to the severed end of the cord. In either event, rewiring of the power cord is time consuming and inconvenient. Moreover, suitable cords and plugs may not be readily available at a work site for replacement of or attachment to the damaged cord.

Another problem with the above-described power tool is that, occasionally, an operator will suspend the power tool by the cord. If the cord is not properly and securely connected to the power tool, the body of the power tool can separate from the cord and fall, possibly injuring another worker or damaging the power tool. Moreover, a non-universal power connection system is generally limited to a specific tool and does not facilitate interchangeability of a power cord with other tools.

Thus, a power connection system solving the aforementioned problems is desired.

SUMMARY OF THE INVENTION

The power connection system provides a base and a removably connectable, replaceable power cord. The power cord can be positively locked to the base in the housing of a power tool to prevent the power cord from being inadvertently disconnected from the electrical circuit and from the housing of the power tool.

In particular, the power connection system is useful for a power tool in which the power tool has a housing defining a recess, a plurality of electrical connector guide grooves, a plurality of arcuate electrical prongs disposed in the recess, an electric motor supported by the housing and operable to drive a tool member, and an electrical circuit connected to the motor. The power cord has a receptacle having complementary arcuate slots for receiving the prongs when connected to the base defined in the power tool housing, the slots being connected to power cord wires with a plug that can be inserted into an A.C. outlet to provide power to the tool. Advantageously, the power cord is quickly and easily removable and replaceable if the cord is damaged or severed. Moreover, the power cord is interchangeable with other power tools having the base, which is a universal adaptation for the cord.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
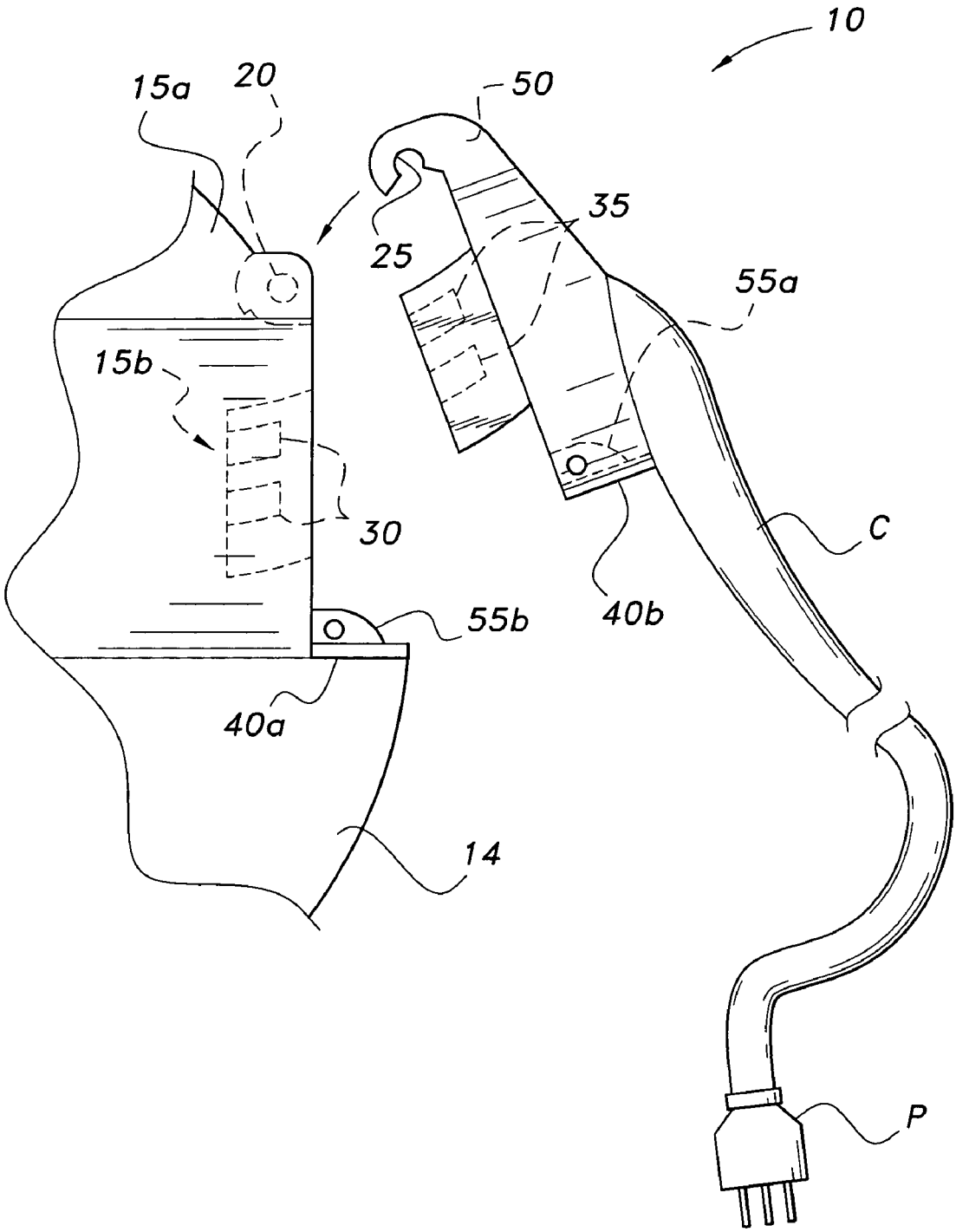
FIG. 1 is an environmental side view of a power tool having a power connection system according to the present invention.
Figure 3:
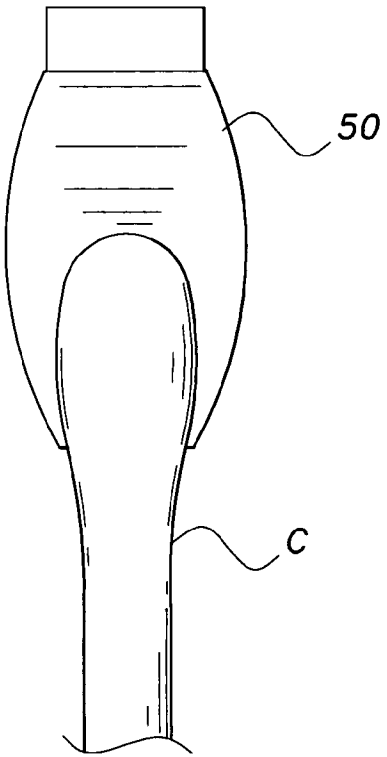
FIG. 3 is an environmental top view of a power tool having a power connection system including an attached power cord.
Figure 2:
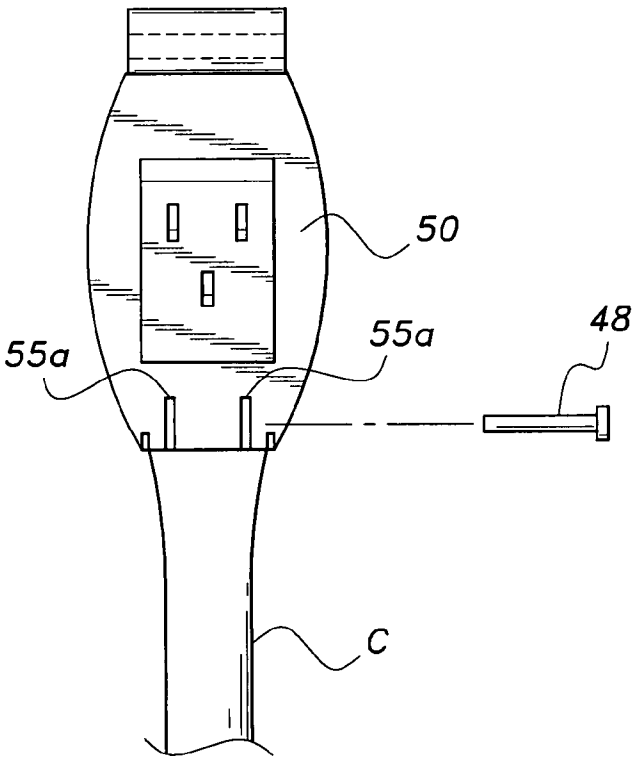
FIG. 2 is a front view of a receptacle portion of a power connection system according to the present invention.
Figure 4:
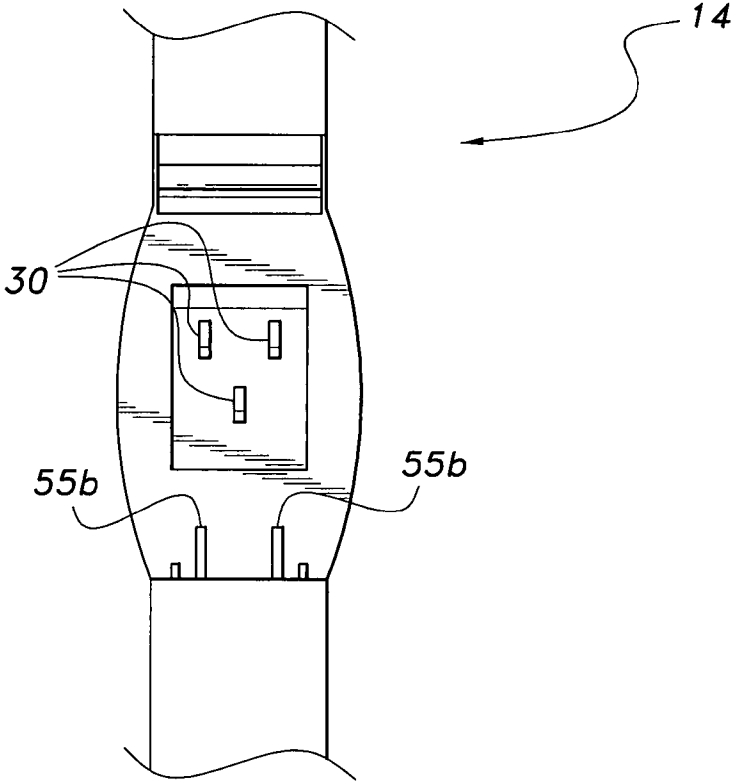
FIG. 4 is a front view of a power tool equipped to receive a cord of the power connection system according to the present invention.

The power connection system provides a power cord and base removably connectable to each other. The power cord can be positively locked to the base, which is defined in a housing of a power tool, to prevent the power cord from being inadvertently disconnected from the electrical circuit and from the housing of the power tool.

In particular, the cord and base provide a power connection system for a power tool in which the power tool has a housing defining a recess and a plurality of electrical connector guide grooves, an electric motor disposed in the housing and operable to drive a tool member, and an electrical circuit connected to the motor. The power cord is connectable to the base defined in the housing and operable to connect the tool to an A.C. power source. The power cord is quickly and easily removable and replaceable if the cord is damaged or severed. Moreover, the power cord is interchangeable with other power tools equipped having a universal base adapted for the cord.

A power tool, including a curved prong adaptor and removable power cord 10 embodying the invention, is illustrated in FIGS. 1-4. In the illustrated construction, the power tool may be any type of tool 14, such as a sander, a drill, reciprocating saw, or the like.

The power tool 14 includes a motor housing having a handle portion 15*a*. An electric motor is disposed in the housing of tool 14 and is operable to drive a tool member, such as a sanding member, drill, or saw. The motor can be electrically connected by an electrical circuit to an on/off switch disposed on the tool 14. The circuit includes arcuate electrical connecting prongs 30 defined in the base for connection with the power cord C.

A recessed portion 15*b* of the handle portion 15*a* defines the base, which provides an enclosure for the arcuate electrical connecting prongs 30. The recessed portion 15*b* supports the power cord C when the power cord C is connected to the housing 14. The power cord 10 includes a plurality of wires, preferably including a hot wire, a neutral wire, and a ground wire having, for example, a conventional three-prong plug P at one end and a clamshell-shaped receptacle 50 at the opposite end, the wires being disposed in an insulated jacket. The tool 14 includes a plurality of electrical connector guide grooves 40*a*, which mate with complementary ridges 40*b* disposed on the powerhead, i.e., clamshell receptacle 50.

The clamshell receptacle 50 of power cord C includes an electrical receptacle having arcuately curved slots 35 having contacts electrically connected to the conductive wires of the cord C. The arcuately curved slots 35 are designed to receive the arcuately curved prongs 30 as the clamshell receptacle 50 is snapped onto and pivoted into the recess 15*b* in the handle portion 15*a* of power tool 14 to provide the tool with electrical power.

The clamshell receptacle 50 has a pivotal joint 25 that engages pivot bar 20 of tool handle portion 15*a*. Complementary grooves 40*a* and 40*b* laterally constrain clamshell receptacle 50 as it pivots into the tool 14. Clamshell receptacle 50 and recess 15*b* also have sets of complementary eyelets 55*a* and 55*b*, respectively. During a connecting procedure by a user, clamshell receptacle eyelets 55*a* are aligned with tool handle eyelets 55*b* and secured by lock pin 48, the lock pin 48 being pushed into the aligned eyelets 55*a* and 55*b*.

Figure 5:
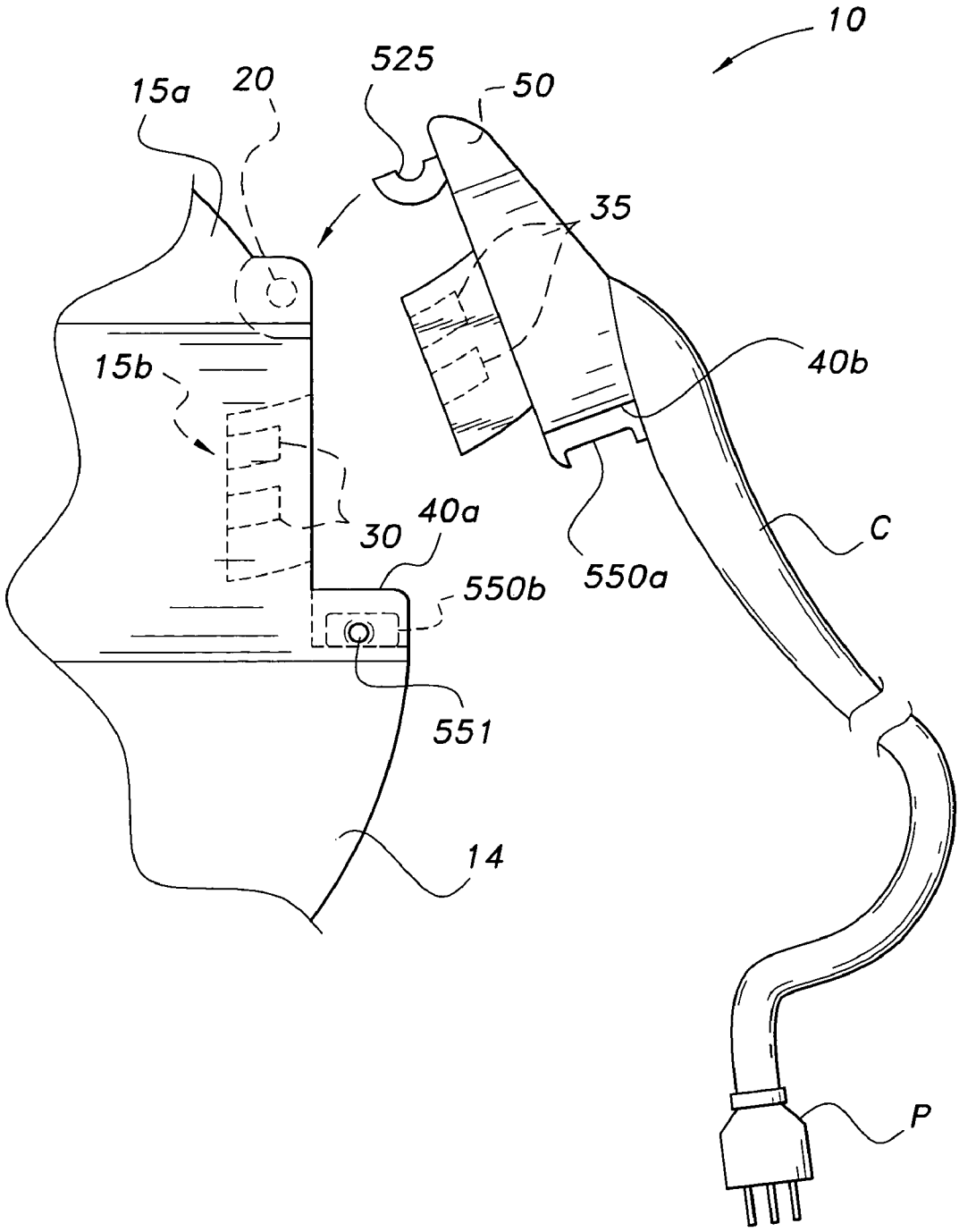
FIG. 5 is a side view of a power tool having a power connection system according to the present invention, including an alternative cord locking feature.

As shown in FIG. 5, alternative pivotal joint 525 of receptacle/power head 50 may be a crescent-shaped, concave member that can directly contact cylindrical pivot bar 20 of tool handle portion 15*a*, rather than hooking around the bar 20 as the aforementioned pivotal member 25 does. Moreover, alternatively to alignment eyelets 55*a* and 55*b*, removable power head member 50 may have a substantially C-shaped hook 550*a* that removably locks into complementary rectangular head 550*b* of lock pin 551. Lock pin 551 is slidable along its axis within recess 15*b*. A cavity inside the recess 15*b* allows the lock pin 551 to slidably engage or disengage the head 550*b* of pin 551 with hook 550*a* to lock and alternatively unlock the removable receptacle 50 from the recess portion 15*b* of tool 14.

Figure 6:
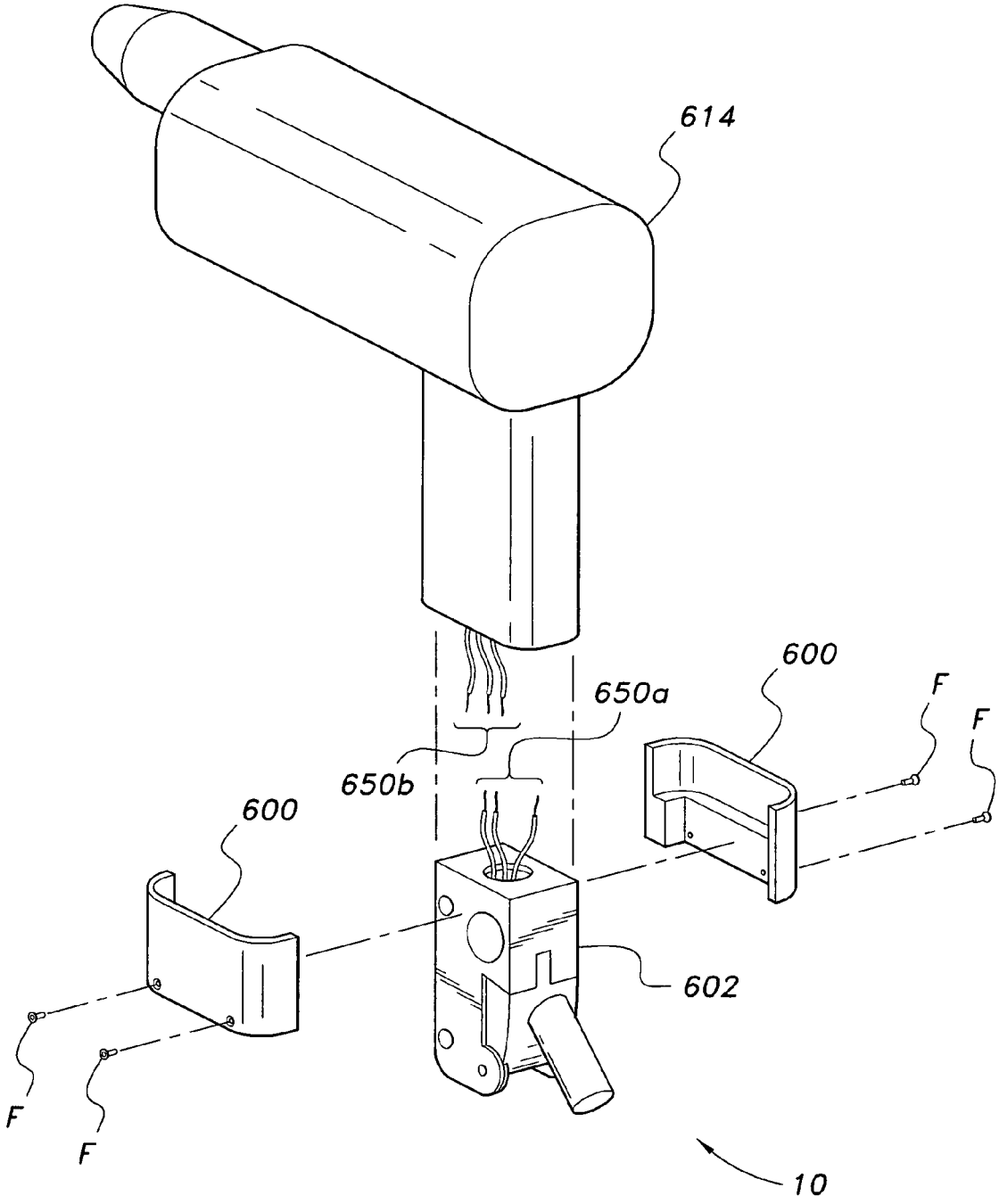
FIG. 6 is a partially exploded, perspective view of a power tool equipped to receive a power cord of the power connection system according to the present invention.

As shown in FIG. 6, the removable power cord system 10 may be packaged as a retrofit unit 602 that can be attached to a power tool 614. Power supplying leads 650*a* are electrically connected (via pig tailing, crimping, soldering, circuit board leads, or any other method known by a person having ordinary skill in the art) to power receiving leads 650*b* of power tool 614. The retrofit unit 602 can be secured to the tool 614 by any means known to persons having ordinary skill in the art. As shown in FIG. 6, the retrofit unit 602 is secured to the tool 614 by retaining collars 600, which are held together by fasteners F.

The power cord C may be easily removed and replaced if damaged during cutting operations. Also, the power cord C is positively locked to the power tool to ensure a conveniently removable electrical and physical connection 10 of the power cord C and the power tool 14.

It will be understood that the arcuate prongs may extend from the power cord and the arcuate slots may be defined in the power tool housing, if desired.

It is to be understood that the present invention is not limited to the embodiment described above, but encompasses any and all embodiments within the scope of the following claims.

I claim:

1. A power connection system for a power tool, comprising:

a power tool having a housing defining a recess;

a first plurality of arcuate electrical contact members extending into the recess, the first plurality of arcuate electrical contact members being electrically connected to a power circuit of the power tool;

an elongated power cord having a plug at one end and an opposite end having a power delivery head, the power delivery head having a second plurality of arcuate electrical contact members disposed therein, the second plurality of arcuate electrical contact members removably mating with the first plurality of arcuate electrical contact members to deliver power to the power tool when the plug is connected to a power source; and a lock pin insertable through the power tool housing and the power delivery head to lock the power delivery head to the power tool.

2. The power connection system according to claim 1, wherein the power head has bores defined therein, the lock pin being removably insertable through the bores.

3. The power connection system according to claim 1, further comprising;

a head disposed on the lock pin, the head having a substantially greater cross-sectional area than that of the lock pin; and a hook disposed on the power delivery head, the lock pin head removably engaging the hook on the power delivery head.

4. The power connection system according to claim 1, wherein the power cord has a plurality of wires, each of the wires being connected to a respective one of the second plurality of arcuate electrical contact members of the power delivery head and extending through the cord to the plug.

5. The power connection system according to claim 1, further comprising:

a crescent-shaped member disposed on the power delivery head; and a pivot bar disposed on the tool, the crescent-shaped member engaging the pivot bar of the tool to align a front portion of the power delivery head with the power tool.

6. The power connection system according to claim 5, wherein the crescent-shaped member has an open face pointing towards the power cord end of the power delivery head.

7. The power connection system according to claim 5, wherein the crescent-shaped member has an open face pointing away from the power cord end of the power delivery head.

8. A power connection system for a power tool, comprising:

a retrofit body having a housing defining a recess and a plurality of electrical conductors extending outside the retrofit body;

a first plurality of arcuate electrical contact members extending into the recess, each of the electrical contact members being electrically connected to a respective one of the electrical conductors;

means for connecting the electrical conductors to respective power receiving electrical conductors of a power tool;

means for attaching the retrofit body to the power tool;

an elongated power cord having a plug at one end and an opposite end having a power delivery head, the power delivery head having a second plurality of arcuate electrical contact members disposed therein, the second plurality of arcuate electrical contact members removably mating with the first plurality of arcuate electrical contact members to deliver power to the power tool when the plug is connected to a power source; and a lock pin insertable through the retrofit body housing and the power delivery head to lock the power delivery head to the retrofit body.

9. The power connection system according to claim 8, wherein the lock pin is removably insertable through bores disposed in the power delivery head.

10. The power connection system according to claim 8, further comprising;

a head disposed on the lock pin, the head having a substantially greater cross-sectional area than that of the lock pin; and a hook disposed on the power delivery head, the lock pin head removably engaging the hook on the power delivery head.

11. The power connection system according to claim 8, wherein the power cord has a plurality of wires, each of the wires being connected to a respective one of the second plurality of arcuate electrical contact members of the power delivery head and extending through the cord to the plug.

12. The power connection system according to claim 8, further comprising:

a crescent-shaped member disposed on the power delivery head; and a pivot bar disposed on the tool, the crescent-shaped member engaging the pivot bar of the tool to align a front portion of the power delivery head with the retrofit body.

13. The power connection system according to claim 12, wherein the crescent-shaped member has an open face pointing towards the power cord end of the power delivery head.

14. The power connection system according to claim 12, wherein the crescent-shaped member has an open face pointing away from the power cord end of the power delivery head.

* * * * *